US008702408B2

(12) United States Patent
Young et al.

(10) Patent No.: US 8,702,408 B2
(45) Date of Patent: Apr. 22, 2014

(54) SLIDE FOR USE IN A SCREW COMPRESSOR

(75) Inventors: Terence William Thomas Young, Kent (GB); John Michael Roll, Kent (GB); Peter Michael Woodard, Essex (GB)

(73) Assignee: AAF McQuay Incorporated, Louisville, KY (US)

( * ) Notice: Subject to any disclaimer, the term of this patent is extended or adjusted under 35 U.S.C. 154(b) by 333 days.

(21) Appl. No.: 13/130,327

(22) PCT Filed: Nov. 20, 2009

(86) PCT No.: PCT/GB2009/002726

§ 371 (c)(1),
(2), (4) Date: Jul. 2, 2011

(87) PCT Pub. No.: WO2010/058182

PCT Pub. Date: May 27, 2010

(65) Prior Publication Data

US 2011/0256011 A1 Oct. 20, 2011

(30) Foreign Application Priority Data

Nov. 20, 2008 (GB) ..... 0821275.5

(51) Int. Cl.
*F03C 4/00* (2006.01)
*F04C 2/00* (2006.01)
*F04C 18/00* (2006.01)

(52) U.S. Cl.
USPC ..... 418/195; 418/201.2

(58) Field of Classification Search
USPC ..... 418/195, 201.1–201.3
See application file for complete search history.

(56) References Cited

U.S. PATENT DOCUMENTS

| | | | | | |
|---|---|---|---|---|---|
| 3,877,846 | A | * | 4/1975 | Lundberg | 418/201.2 |
| 4,544,333 | A | * | 10/1985 | Hirano | 418/201.2 |
| 4,579,513 | A | | 4/1986 | Zimmern et al. | |
| 4,610,613 | A | | 9/1986 | Szymaszek | |
| 2010/0284848 | A1 | | 11/2010 | Fujiwara et al. | |

FOREIGN PATENT DOCUMENTS

| | | | | | |
|---|---|---|---|---|---|
| EP | 2 246 572 | A1 | | 11/2010 | |
| GB | 2 173 257 | | | 10/1986 | |
| JP | 01163486 | A | * | 6/1989 | 418/201.2 |
| JP | 2009 174527 | | | 8/2009 | |

* cited by examiner

*Primary Examiner* — Theresa Trieu
(74) *Attorney, Agent, or Firm* — Joyce von Natzmer; Agris & von Natzmer LLP

(57) ABSTRACT

A slide for use in a single screw compressor is disclosed. The screw compressor is arranged to vent the flutes of its main rotor at all times, without having to provide a check valve in the discharge port of the main rotor casing. An additional outlet port in the casing vents gas from the discharge ends of the flutes into the body of the slide instead of to the discharge port. The vented gas is guided to an exit port of the slide, from where it can reach either the discharge port or the bypass port of the casing at all times during use of the compressor and under all loading conditions. The design of the disclosed slide further allows the use of an offset discharge port in the casing, in relation to the main rotor.

17 Claims, 11 Drawing Sheets

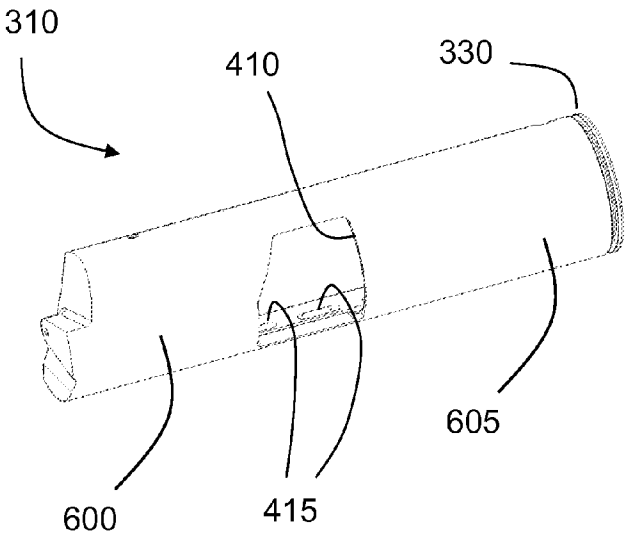
Figure 6
Figure 4
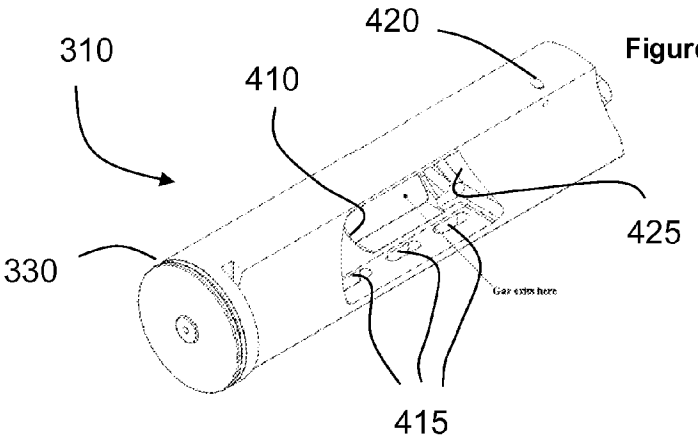
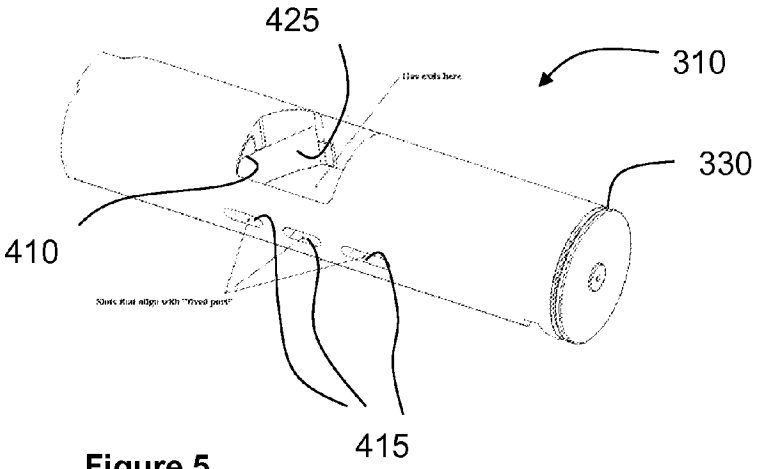
Figure 5

Figure 12
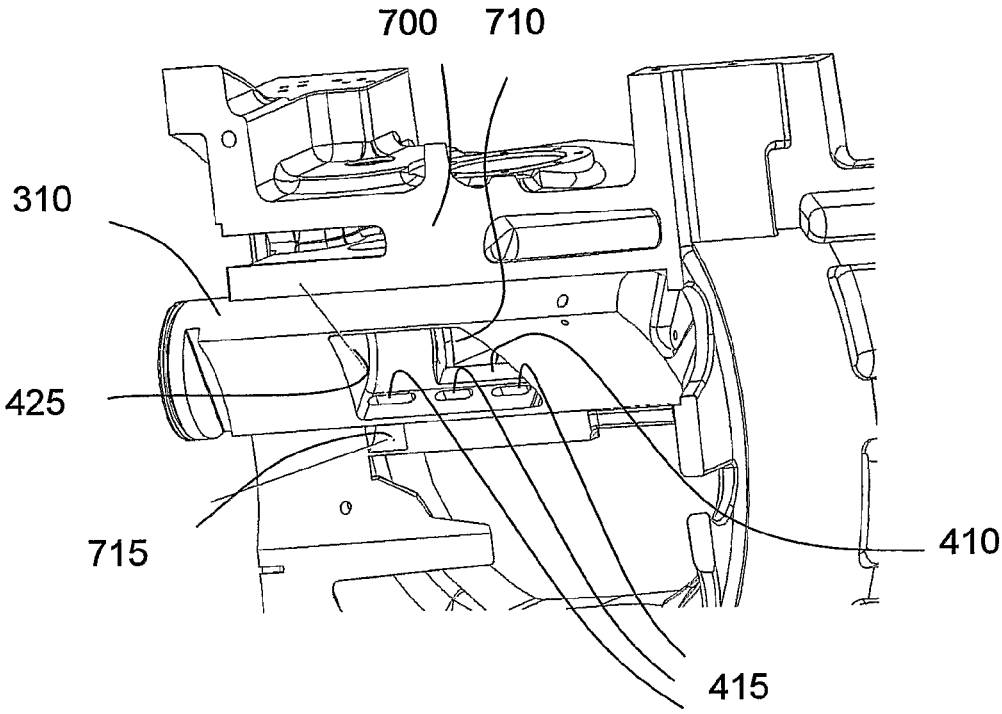
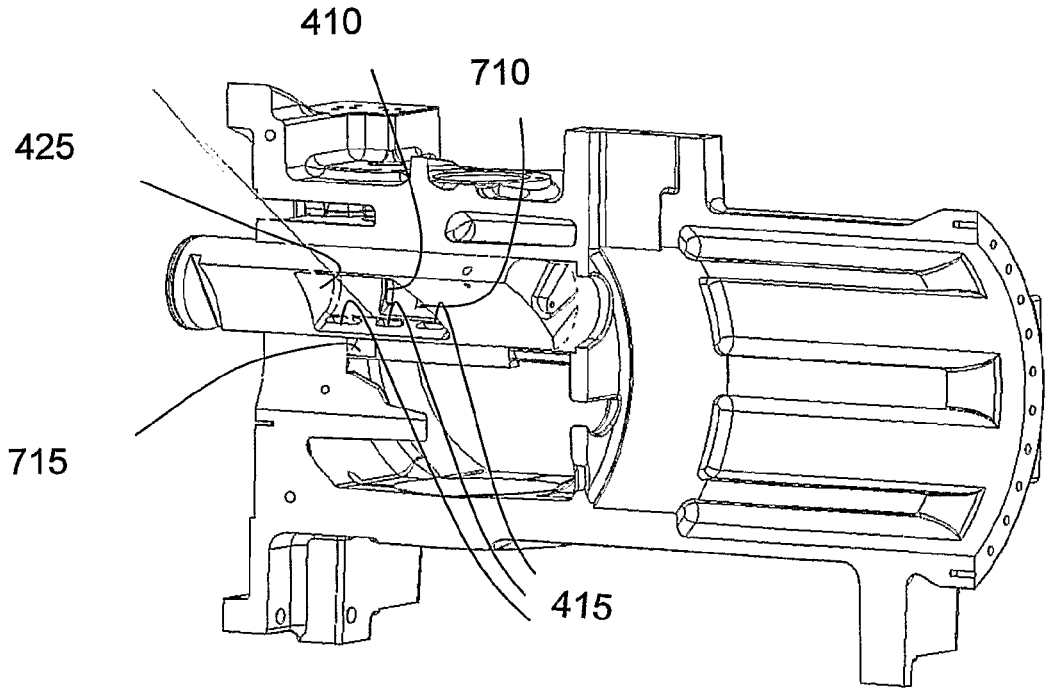
Figure 13

Figure 14
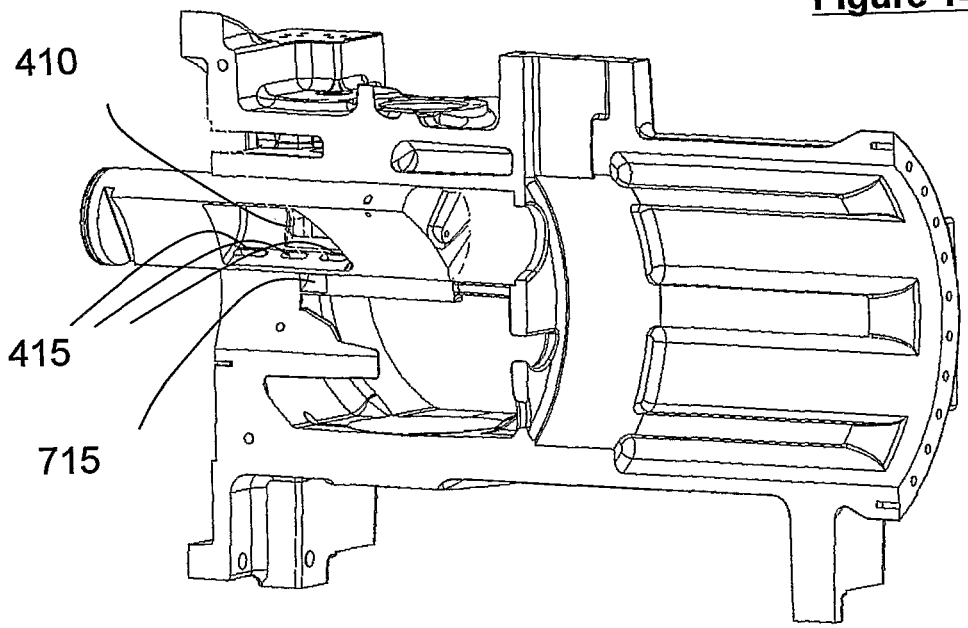
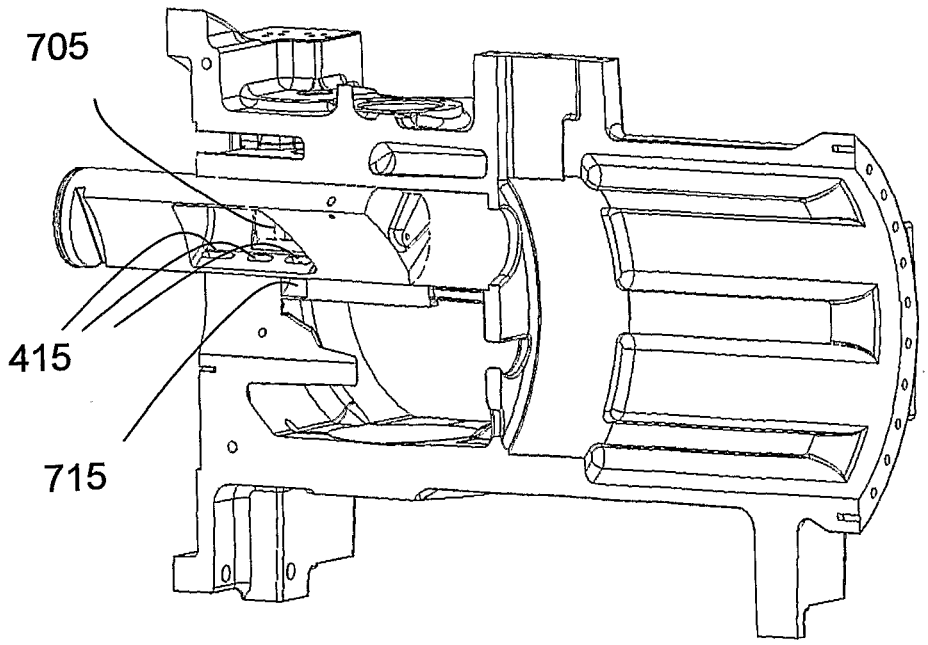
Figure 15

SLIDE FOR USE IN A SCREW COMPRESSOR

CROSS REFERENCE TO RELATED APPLICATIONS

This is the U.S. national stage of International application PCT/GB2009/002726, filed Nov. 20, 2009 designating the United States and claiming priority to GB application GB 0821275.5, filed Nov. 20, 2008.

BACKGROUND OF THE INVENTION

1. Field of the Invention

The present invention relates to screw compressors. It finds particular application in a single screw compressor having a main rotor and two or more meshing gate rotors.

2. Description of Related Art and Introduction

Screw compressors have become increasingly popular for refrigeration and air conditioning applications in recent years. Their high reliability, small size and weight for a given capacity, make these compressors ideal for use in packaged chiller units. Environmental issues are increasingly important and thus also efficient operation of these chillers.

The single screw compressor is a known type, comprising a single main rotor 100 with two meshing gate rotors 110, 115. An example of these rotors is shown in FIG. 1. The single main rotor 100 has a number of helical screw threads 105, sometimes referred to as "flutes", which are cut with a globoid (or hour glass) shape to the roots of these threads. The threads 105 have a relatively large cross section at an input end 120 and a significantly smaller cross section at a discharge end 125.

Suction gas enters the flutes 105 at the large openings at the input ends 120, in a generally axial direction with respect to the main rotor 100. The gas is then sealed into the flutes 105 by the gate rotors 110, 115 and casing (not shown) as the rotor assembly 100, 110, 115 rotates, the discharge ends 125 of the flutes 105 normally being closed by the casing. Continued rotation causes the teeth of the gate rotors 110, 115 to progress along the flutes 105 causing a reduction in volume and thus an increase in pressure. The compressor is so designed that when the desired pressure increase has been reached the flute opens to a discharge port in the casing and continued rotation causes the refrigerant gas to be driven out through the discharge port. The design allows for this compression process to be mirrored on both sides of the main rotor 100 by the use of two gate rotors 110, 115.

FIG. 1 shows a compression process in three different rotational positions. In a first position, shown to the left in FIG. 1, a gas-filled flute 105 has a relatively large volume, indicated by a dotted area. As the input end 120 is sealed by a tooth of a gate rotor 115 which begins to move along the gas-filled flute 105 during rotation of the rotor assembly 100, 110, 115, the volume of the gas-filled flute 105 reduces, as shown in the middle of FIG. 1. The volume of the gas-filled flute 105 reaches a minimum just as its discharge end 125 comes level with a discharge port (not shown) in the casing. This last rotational position is shown to the right in FIG. 1. The gas expands as it is released through the discharge port. This process is repeated for each consecutive flute 105.

It is not always necessary or desirable to run a compressor at full capacity. In the past it has been sufficient to produce units that operate efficiently at full load, but it is well known that for most of the time the average chiller is used at between 25% and 75% of full capacity. The importance of high efficiency in these operational bands is recognised by both ARI and Eurovent. The Eurovent index ESEER, a rating very similar to ARI IPLV, provides a realistic overall efficiency figure by applying weighting coefficients to efficiencies at various part loads. The following table shows these weighting coefficients across a set of ESEER parameters:

| Part load Ratio | Air Temperature (° C.) | Water Temperature (° C.) | Weighting Coefficients |
|---|---|---|---|
| 100 | 35 | 30 | 3% |
| 75 | 30 | 26 | 33% |
| 50 | 25 | 22 | 41% |
| 25 | 20 | 18 | 23% |

It can be seen that the weighting coefficients are much higher for the part load ratios 25% to 75%.

Various unloading mechanisms have been developed in order to provide compression at a reduced rate. In the screw compressor, the integral arrangement that has become virtually universal nowadays is some form of axial slide. These are used to adjust two factors: capacity and volume ratio. Capacity is controlled by determining the position along a flute 105 at which gas is taken in. The volume ratio is the relationship between the volume of trapped gas at the start of a compression process in a flute 105 and the volume of the trapped gas when it first starts to discharge from the flute 105. An arrangement utilised in most single screw compressor types incorporates two axially moving slides, sitting in a recess inside the casing, adjacent to and sealing part of the compressor rotor. In the standard arrangement, axial movement of the slides opens or closes ports in the compressor casing to achieve changes in the capacity and the volume ratio. In practice, a bypass port in the casing effectively delays the start of compression and it is this port which is progressively opened or closed to control capacity. A discharge port at the other end of the casing is simultaneously modified to control the volume ratio.

Referring to FIG. 2, a port 205 cut in a slide 200 that's otherwise arranged for capacity control also allows it to control the opening of a discharge port in the casing. Thus the slide 200 performs two distinct functions, the first to adjust the capacity, the second to maintain the appropriate volume ratio. Careful design of the slide 200 can produce arrangements that either maintain a fixed volume ratio over most of the operating range or provide a changing volume ratio to match anticipated changes in the operating pressures at part load.

In a further refinement, it is possible to separate these two functions by dividing the slide into two separate sections.

In the single screw compressor with two gate rotors 110, 115 as shown in FIG. 1, there are two sets of compression processes that occur at the same time, one for each gate rotor 115 as it sweeps through flutes 105 on one side of the main rotor 100. Each set of compression processes is therefore provided with an unloading slide 200. It is known to use such slides asymmetrically, to give different loading in their respective compression processes at the same time. The ability to provide different loading in each of at least two compression processes can produce a compressor whose operation is more efficient when part-loaded.

Preferably, a first of the at least two slides is operable to move between a fully loaded position and a fully unloaded position while a second of the at least two slides is operable to move to any of a range of partially loaded positions. Such an arrangement allows the compressor to operate through a wide loading range, potentially extending from very low loading through to fully loaded.

BRIEF SUMMARY OF THE INVENTION

According to a first aspect of embodiments of the present invention, there is provided a slide for use in a single screw compressor, the compressor comprising a casing having a discharge port and a bypass port spaced in an axial direction in relation to the main rotor, the slide comprising an exit port positioned between first and second sealing surfaces, and at least one inlet port for receiving gas from flutes of the main rotor for delivery to the exit port, the slide being operable to move between:

i) a loaded position in which the exit port opens to the discharge port in the casing and the first sealing surface seals the bypass port, and ii) an unloaded position in which the exit port opens to a bypass port in the casing and the second sealing surface seals the discharge port.

Preferably the compressor casing has an additional outlet port, providing an opening to the discharge ends of the flutes at a position outside the slide, between the slide and an associated gate rotor, and the slide comprises at least one additional inlet port for receiving gas from the additional outlet port in the casing for delivery to the exit port.

In known compressors, a problem can arise at the end of the compression process with gas trapped in the last portion of a flute. A known solution is to provide an exit path for the gas, past the slide entirely and directly to the discharge port. This then requires a non-return or check valve to be provided in the discharge port to prevent leakage back to the flute during other stages of the compression process.

In embodiments of the present invention, an exit path is provided from that last portion of the flute, via the additional outlet port in the casing and into the slide for delivery to the exit port of the slide. Depending on the stage in the compression process, this might deliver the gas either to the discharge port or to the bypass port. There is no path from the flutes to the discharge port without going through the slide.

This has two advantages. It eliminates the need for a non-return or check valve in the discharge port and it can also facilitate movement of the slide between the loaded and unloaded positions. The compression process can remain fully vented throughout.

In order for the compression process to remain fully vented in all potential positions of the slide, the additional inlet port provided in the slide preferably extends in an axial direction in relation to the main rotor such that the additional outlet port in the casing always communicates with the additional inlet port. For robustness, the additional inlet port provided in the slide is preferably provided as a series of two or more openings rather than a single opening In this case, the distance between the openings needs to be less than the dimension of the additional outlet port in the casing in said axial direction, at the junction between the openings and the additional outlet port.

A form of slide which can accommodate the inlet port, exit port and the additional inlet port comprises a rod-like body, cut away to provide a face to fit against the outer surface of the main rotor. This face provides the inlet port. A recess in the face provides a path from the inlet port to the exit port which is generally in a "rear" surface of the slide, facing towards the discharge and bypass ports in the casing, in use. The additional inlet port is provided to give access into the recess, between the inlet port in the face and the exit port, in a generally circumferential direction of the rod-like body. For example, the rod-like body might be generally cylindrical.

Since the exit port in the slide moves between positions in which it opens to a bypass port and a discharge port respectively, the bypass port and the discharge port in the casing are preferably at least partially aligned with one another in the direction of movement of the slide. A slide as described above will normally move in an axial direction in relation to the primary rotor and thus the bypass port and the discharge port in the casing will be at least partially aligned in the axial direction for compactness.

The use of a single slide for both bypass port and discharge port allows the slide to combine functions in one item. It can operate in conventional manner to provide control of the volume ratio to match required operating conditions of the compressor and it also allows some new features. For example, it can support:

an offset discharge port to provide better support of the slide isolation of the discharge port when the compression process is fully unloaded thus eliminating the need for a check valve (described above)

variable volume ratio when the process is loaded

Better support of the slide can be offered by the positioning of the discharge port in the casing to ensure that the pressure distribution on the rear surface of the slide acts so that the slide is not pushed towards the main rotor but for example is held against a bearing housing. The design of the slide can at least partially facilitate this offset discharge port by having a thicker body than slides of the prior art, the body accommodating a guiding recess, or channel, between the inlet port and the exit port of the slide. Instead of gas venting directly through a slide port to the discharge port in the casing, it is guided along the slide to a discharge port in the casing which lies opposite the bearing housing instead of opposite the main rotor. Preferably therefore, the slide has the rod-like, preferably generally cylindrical, body mentioned above, allowing it to be driven and guided in an axial direction with respect to the main rotor while giving a body of sufficient thickness to determine the direction of discharging gas to reach an offset discharge port, achieving the above-mentioned support of the slide.

In common with other types of screw compressor, oil is injected during the compression process in a single screw compressor to provide sealing of leakage paths. In preferred embodiments of the invention, the slide has an oil pathway for injection of oil which is in register with an oil delivery channel when the compression process is in the fully loaded state. Movement of the slide will take the oil pathway out of register and interrupt this oil supply. Oil injection via the oil pathway in the slide into the compression process will then be stopped, maximising overall efficiency of the compressor at part load. This efficiency gain is due to reduced churning losses in the unloaded compression process and a reduction in the refrigerant that comes out of solution from the injected oil. Typically refrigerant oil will contain 20% or more dissolved refrigerant that can come out of solution at the low pressures, thereby reducing efficiency.

Embodiments of the invention might be used in a single screw compressor to provide asymmetric unloading. Where there are for example two gate rotors creating two sets of compression processes that occur at the same time, as described above, one on each side of the primary rotor, each set of compression processes can be provided with a differently positioned slide. For example one of the slides can be placed in a fully unloaded or fully loaded state while the other of the slides can be set to operate in a position that gives from 12% to 50% capacity. This combination offers an operating range from 12% to 50% capacity and from 62% to 100%; Asymmetric capacity control of this type can be seen as combining the advantages of a large screw compressor with the advantages of a multi compressor installation. Due to the very large ports that can be incorporated in a single screw compressor, there can be virtually no compression in the unloaded side and virtually no port losses. Thus this concept is more akin to the multi compressor arrangement where unloading is achieved by switching off compressors, than to conventional screw unloading.

According to a second aspect of embodiments of the present invention, there is provided a single screw compressor for use with a slide according to the first aspect, the compressor having one or more of the features mentioned above in relation to said slide.

As mentioned above, to accommodate said slide, the compressor might for example provide a casing for the main rotor having a discharge port and a bypass port at least partially aligned with one another in the axial direction in relation to the rotor. Preferably, the discharge port is arranged to face a surface offset from the main rotor, for example provided by a bearing housing of the compressor, rather than adjacent the main rotor, so that pressures acting through the discharge port in use of the compressor push the slide against the surface rather than towards the main rotor.

Where the slide has an additional inlet port, the compressor might for example provide a casing for the main rotor which has a bypass port, a discharge port and an additional outlet port providing a path from the discharge ends of the flutes to said additional inlet port in the slide.

The additional outlet port might be placed at a position outside the slide, in use of the compressor, between the slide and an associated gate rotor. The additional outlet port might be provided by a shaped channel in the casing that directs gas from the discharge ends of the flutes to the additional inlet port in the slide.

Where the slide has an oil pathway for injection of oil, the compressor might be provided with an oil delivery channel which is in register with the oil pathway only when the compression process is in the fully loaded state.

It is to be understood that any feature described in relation to any one aspect or to any one embodiment of the invention may be used alone, or in combination with other features described, in relation to the same or one or more other aspects or embodiments of the invention if appropriate.

BRIEF DESCRIPTION OF THE DRAWINGS

A single screw compressor according to an embodiment of the invention will now be described, by way of example only, with reference to the accompanying figures in which:

FIG. 4 shows in three quarter view from above a three dimensional view of an upper slide for use in the compressor of FIG. 3, showing a concave inner surface of the slide that faces the primary screw in use;

FIG. 5 shows the upper slide of FIG. 4 in three quarter view from below;

FIG. 6 shows the upper slide of FIG. 4 from the rear;

FIGS. 12 to 15 show in three quarter view from above a partly cut away, three-dimensional view of the upper slide of FIGS. 4 to 6 mounted in different loading positions in the casing shown in FIG. 7;

DESCRIPTION OF VARIOUS AND PREFERRED EMBODIMENTS

In the compressor described herein, the slide operation is driven by hydraulic cylinders but any suitable means of drive could be used, such as stepping motors.

Figure 1:
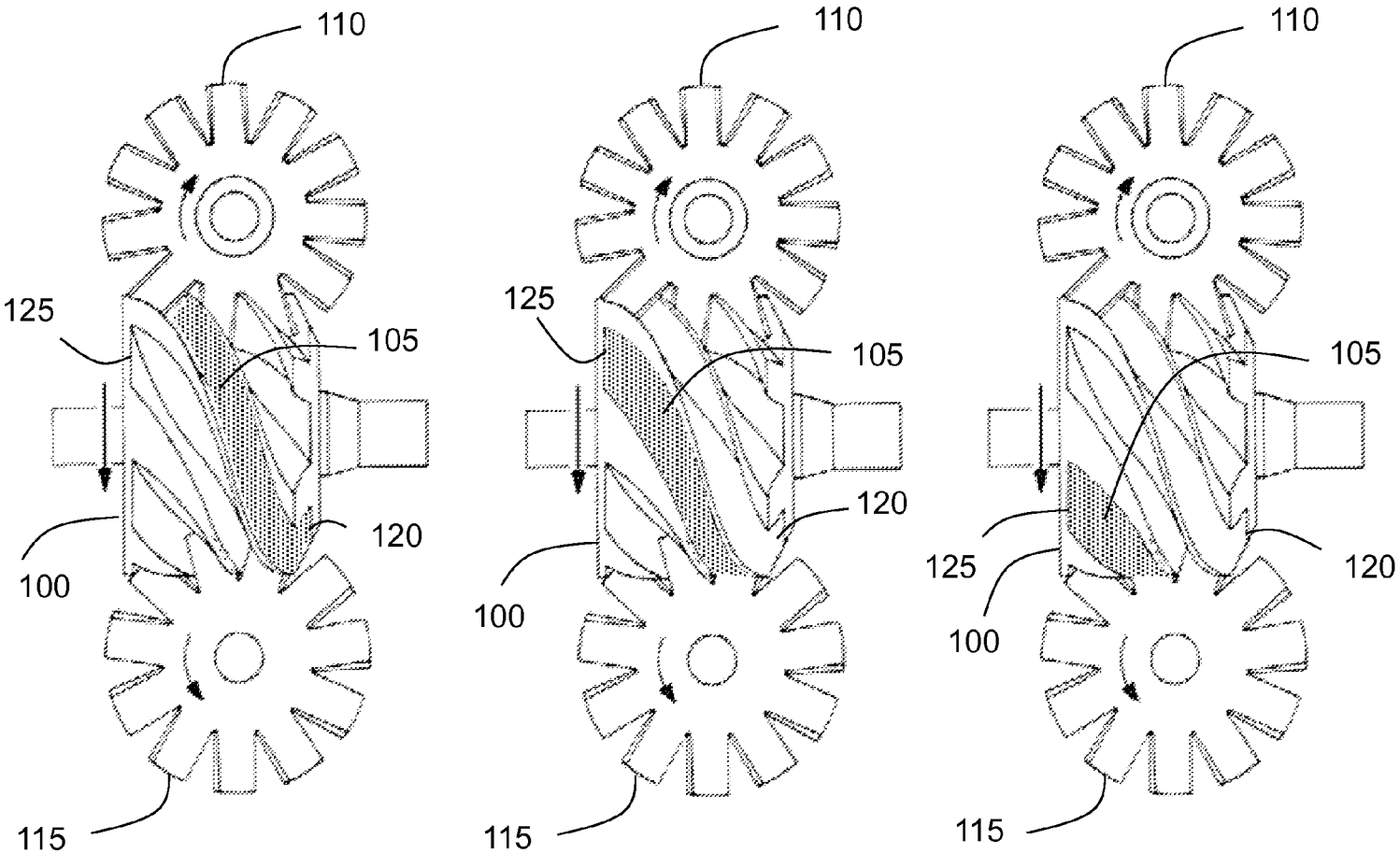
FIGURE 1 PRIOR ART
FIG. 1 shows a series of three diagrammatic views from above of a primary screw and two gate rotors of a single screw compressor, in different stages of compression.
Figure 2:
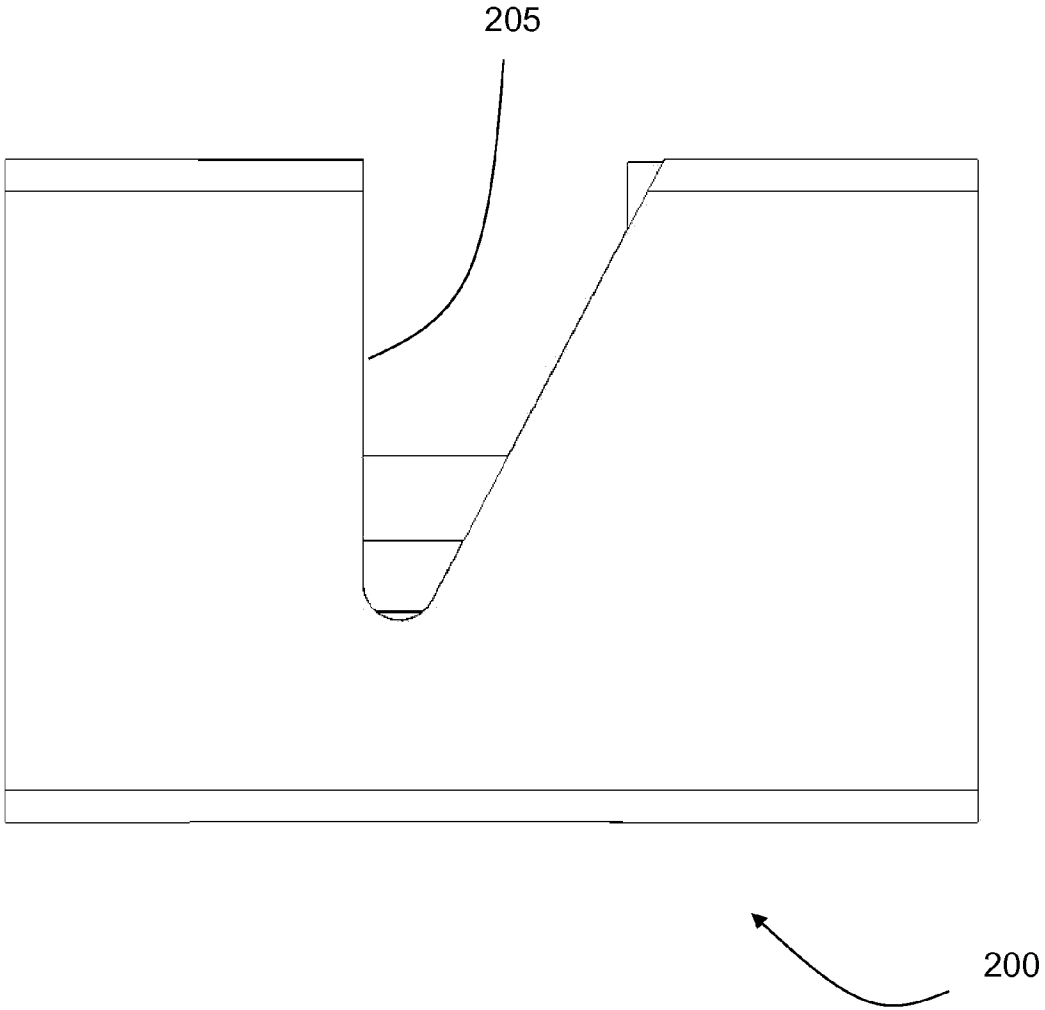
PRIOR ART Figure 2
FIG. 2 shows in side elevation a slide according to the prior art.
Figure 3:
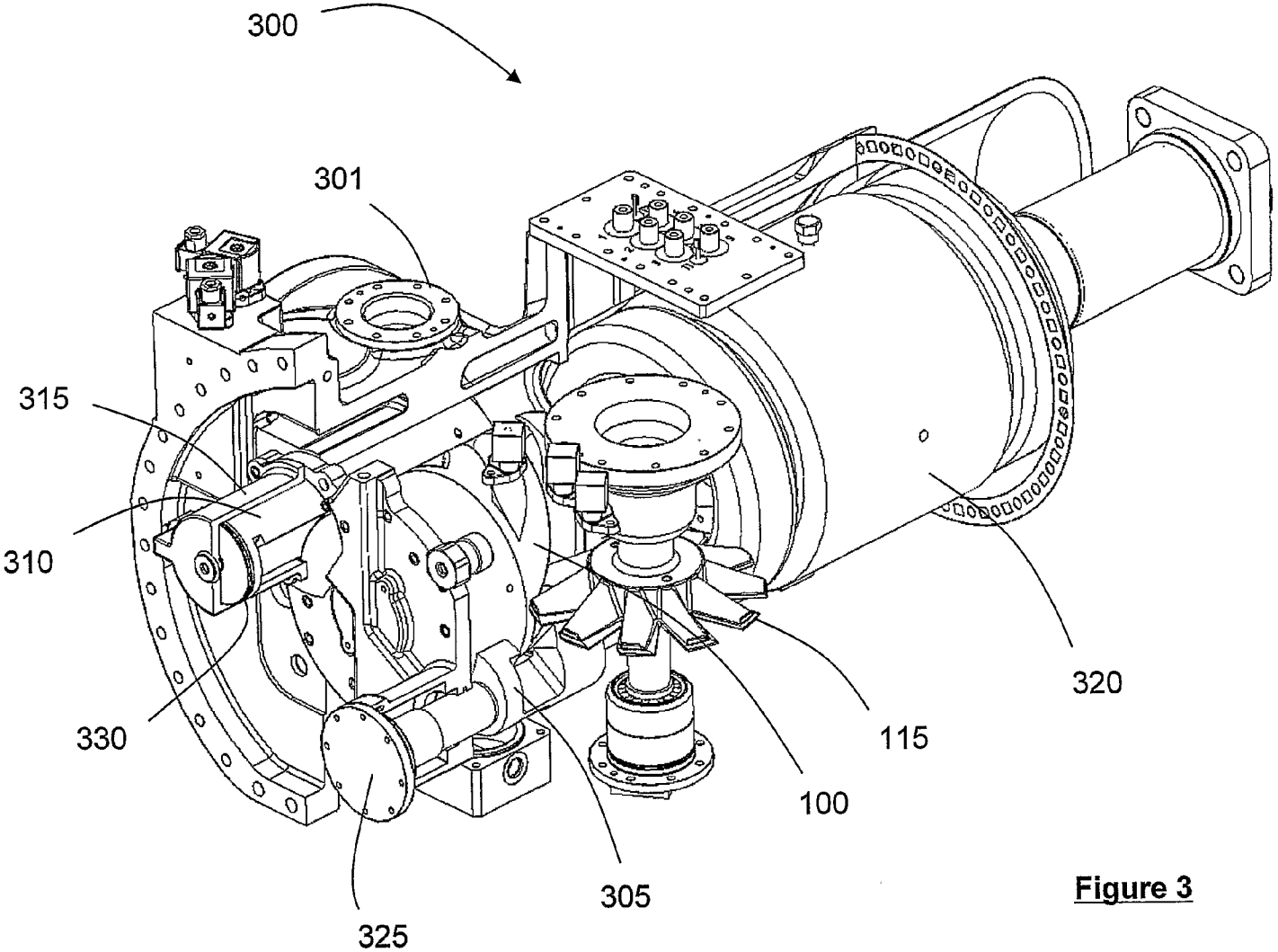
FIG. 3 shows in three quarter view from above a partly cut away, three-dimensional view of the compressor according to an embodiment of the invention, showing the position of upper and lower slides.

Referring to FIGS. 3 and 4, the compressor 300 is of the general type described above in relation to FIG. 1, having a main rotor 100 inside a semi hermetic casing (not shown). There are two gate rotors 110, 115, only one of which is visible in FIG. 3. The position of the second gate rotor can be seen in the figure from the position of an associated housing 301. Each gate rotor 110, 115 has an associated slide 305, 310. The main rotor 100 is driven by a suction gas cooled motor 320. The arrangement of the main and gate rotors is of known type with the gate rotors 110, 115 sitting diametrically opposite one another with regard to the main rotor.

Embodiments of the invention take advantage of the unique single screw compressor geometry which, as described above, gives two identical compression processes taking place on opposite sides of the main rotor, by exploiting the possibility of completely unloading one side of the compressor whilst keeping the other side of the compressor at full or part load.

FIG. 3 shows the slide arrangement in the new compressor design. Each slide 305, 310 is mounted for axial movement relative to the main rotor 100, adjacent to one of the gate rotors 110, 115. A first (lower) slide 305 extends below and past a first gate rotor 115, while a second (upper) slide 310 extends past the second gate rotor. The general positioning of the slides and the axial direction of their movement relative to the main rotor, in use of the compressor 300, is conventional.

The lower slide 305 is designed to provide fully modulating control while the other slide 310 is intended to work in either the fully loaded or unloaded position. The lower slide 305 is infinitely adjustable, allowing the compressor 300 to precisely match the required system capacity. This slide 305 can cover a range of 12% to 50% of the total capacity of the compressor 300 when operating by itself. Thus for load requirements varying from 12 to 50% the top slide 310 is held in the fully unloaded position whilst the bottom slide 305 is moved to match the precise load requirement. For loads between 62 and 100% load the top slide 310 is fully loaded and the bottom slide 305 adjusted to precisely match the load requirement.

Both slides 305, 310 are controlled by hydraulic cylinders operating on the end of the slides. In the case of the lower slide 305 this is via a piston 325 attached to the end of the slide and in the case of the top slide 310 a piston 330 is incorporated into the end of the slide thus simplifying the design and reducing the number of components. However, other forms of control, such as a stepper motor, could be utilised if desired.

Referring to FIGS. 4 to 6, the upper, or top, slide 310 is designed to operate in either the full load or zero load condition. It has a generally cylindrical body with a piston 330 at one end by means of which it can be driven between its loaded and unloaded positions in a bore in the casing of the main rotor 100 of the compressor 300. The slide 310 has a central exit port 410 flanked by a first sealing surface 600 and a second sealing surface 605 for gas leaving flutes 105 of the main rotor, opening from a recess 425 in the face of the slide 310 facing the main rotor 100.

When moving between the full load and zero load conditions, it is important that the compression process is always vented. This is achieved in part by an additional inlet port comprising a series of slots 415 in the side of the slide 310. These slots, together with a new outlet port in the casing of the main rotor 100, provide a path from the discharge ends of the flutes 105 of the main rotor 100 into the slide 310, ensuring that the compression process is fully vented and also eliminating the potential compression that remains at the end of the conventional unloading arrangement. These slots 415 and their operation are more fully described below.

Figure 8:
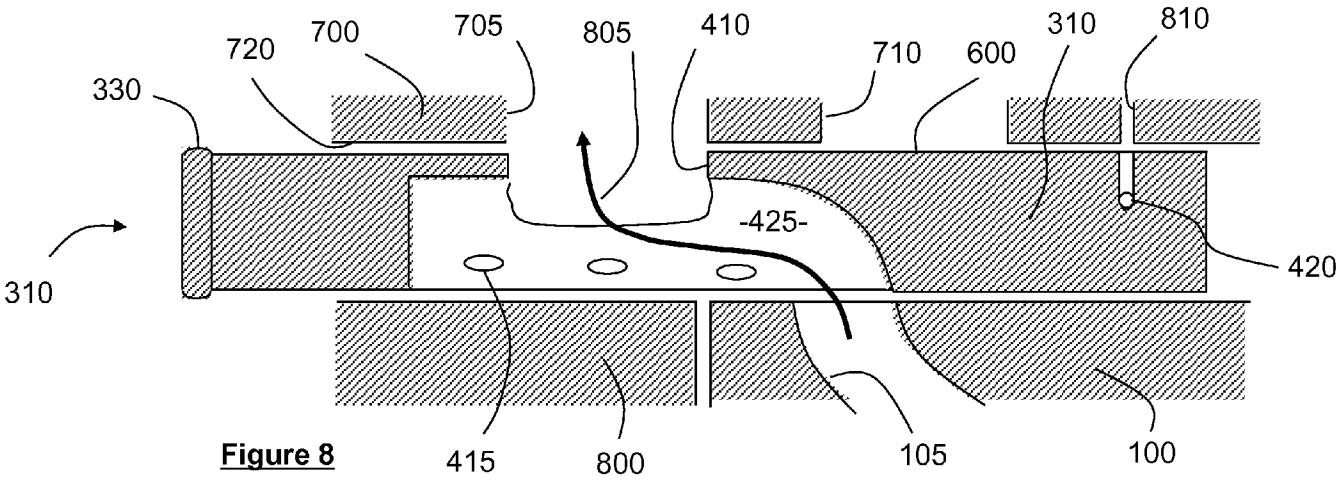
FIGS. 8 and 9 show diagrammatically, in cross section, the upper slide of FIGS. 4 to 6 in loaded and unloaded positions with regard to an offset discharge port in the casing shown in FIG. 7.
Figure 9:
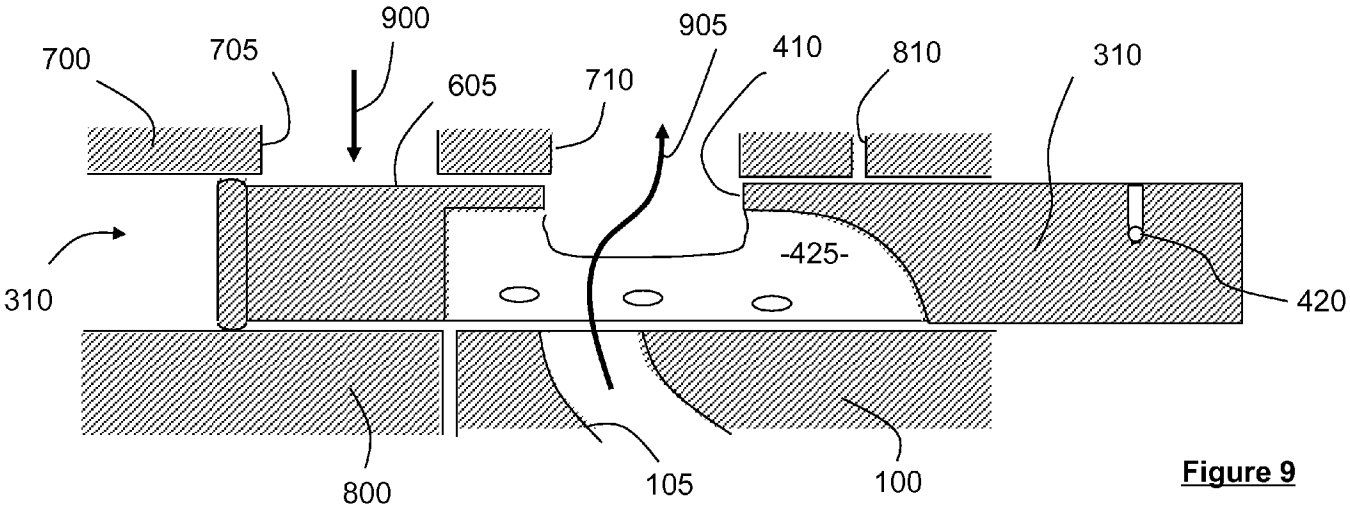

The slide 310 is also provided with an oil delivery channel 420, the operation of which is further described in relation to FIGS. 8 and 9.

FIG. 5 shows the slide 310 in three quarter view from below, showing in particular the exit port 410 and the slots 415 in the external surface of the slide 310.

FIG. 6 shows the slide 310 in quarter view from the rear, showing in particular the exit port 410 in the external surface of the slide 310 and the slots 415 opening into the recess 425 inside the slide 310.

Figure 7:
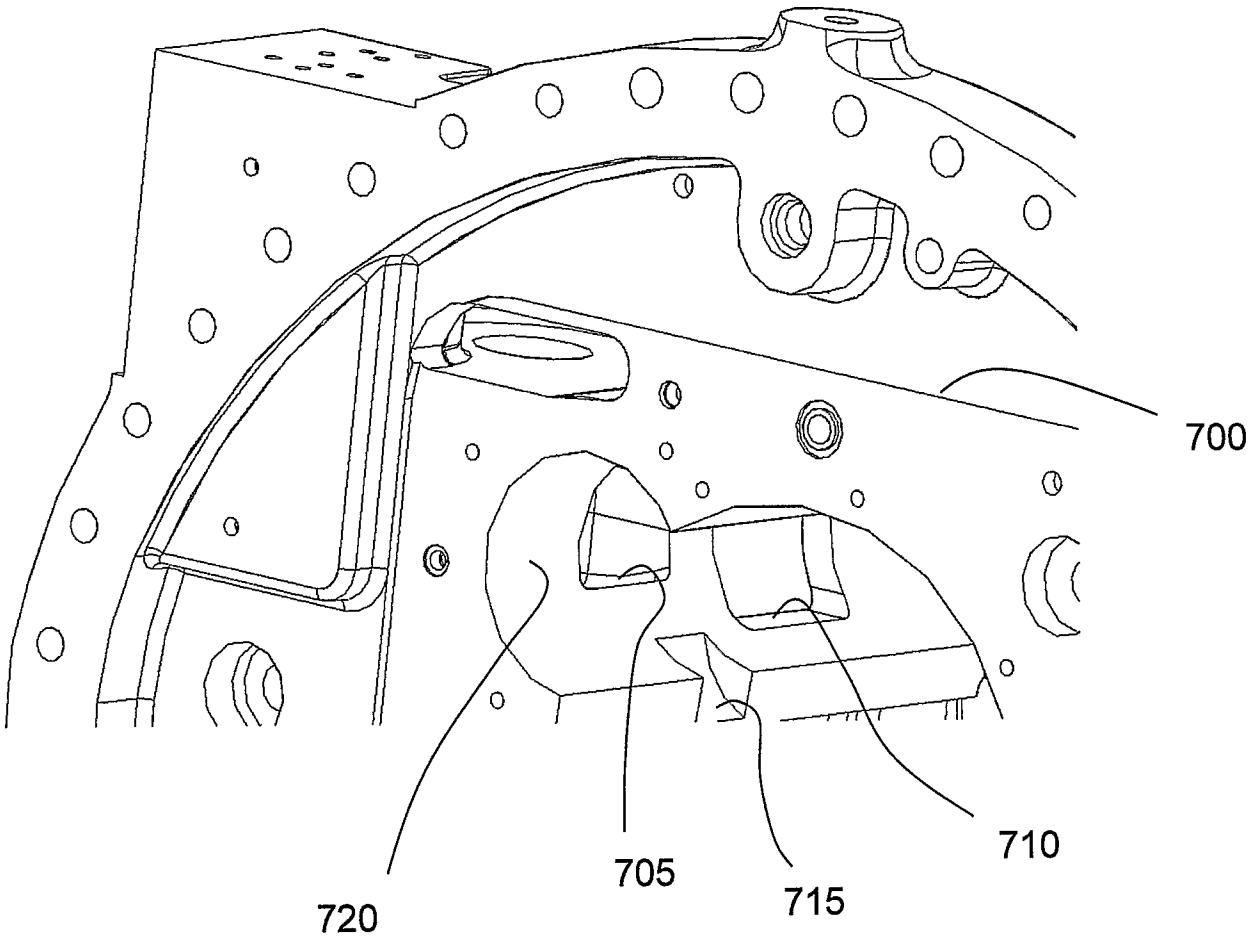
FIG. 7 shows, in three quarter view from above, a portion of a casing of the compressor that houses the upper slide, and in particular a set of three ports for communicating with the slide in use of the compressor.

Referring to FIG. 7, a casing 700 is provided for both the main rotor 100 (not shown in FIG. 7) and the slides 305, 310 (not shown in FIG. 7) of the compressor 300. This casing 700 is provided with a discharge port 705, a bypass port 710 and an additional outlet port 715, all opening into a bore 720 in the casing for receiving the upper slide 310. The discharge port 705 and the bypass port 710 are at least partially aligned in the axial direction of the main rotor 100. This allows the exit port 410 of the axially mobile slide 310 to move between the loaded and unloaded positions, aligned in turn with the discharge port 705 and the bypass port 710. The additional outlet port 715 is between the discharge port 705 and the bypass port 710 in the axial direction and offset in the circumferential direction of the generally cylindrical slide 310. This allows it to communicate with the discharge ends 125 of the flutes 105 outside the slide 310. The additional outlet port 715 is in the form of a shaped channel in the casing that directs gas from the discharge ends 125 of the flutes 105 to the additional inlet port in the slide 310 provided by the slots 415. The operation of the additional outlet port 715 is further described in relation to FIGS. 10 to 15.

The discharge port 705 accepts gas from a particular point on the compression process, allowing it to pass through the slide 305, 310 and to be "directed" forward into a main chamber before it enters an oil separator and away into a cooling system, only to return at the opposite end of the compressor 300, to be compressed again. The bypass port 710 allows gas at other points in the compression process to return to suction for compression.

Referring to FIGS. 8 and 9, in use the slide 310 is mounted in the bore 720 in the casing 700 of the compressor, partially adjacent to the main rotor 100 and partially adjacent to a housing 800 of a bearing (not shown). It can be moved by means of its piston 330 from a loaded position, shown in FIG. 8 in which the exit port 410 of the slide 310 is aligned with the discharge port 705, to a fully unloaded condition, shown in FIG. 9, in which the discharge port 705 is blocked and the exit port 410 of the slide 310 is aligned with the bypass port 710.

It can be seen that in both positions, the discharge port 705 is offset in the axial direction of the main rotor 100, being opposite the bearing housing 800 rather than the main rotor 100. This has the effect, particularly in the unloaded position when there is pressure (indicated by the arrow 900 in FIG. 9) back through the discharge port 705, of directing any such pressure towards the bearing housing 800 rather than the main rotor 100. This offers better support of the slide 310.

As described above, the exit port 410 of the slide 310 is provided from a recess 425 in the face of the slide 310 facing the main rotor 100. This recess 425 is extended beyond the exit port 410 in the axial direction of the main rotor 100 and provides pathways 805, 905 for gas exiting the flutes 105 to the discharge port 705 and the bypass port 710 respectively. This extended recess 425 allows communication from the flutes 105 to the discharge port 705 and/or the bypass port 710 at all times, even when the discharge port 705 is blocked. In part this is due to the presence of the slots 415.

Oil injection into the compression process is used to seal the leakage paths in the compressor. In known arrangements, oil is normally injected into both top and bottom compression processes. However when the top compression process is fully unloaded this oil forms no useful function and the viscous drag and dissolved refrigerant entrained in the oil are detrimental to the compressor efficiency.

Referring to FIGS. 8 and 9, in embodiments of the present invention, the oil injection is so arranged as to pass through the slide 310 such that at full load the oil is injected into the compression process but once this slide 310 is unloaded then the oil injection is blocked by the slide 310 and thus this potential loss in efficiency is removed. This is achieved by the presence of an oil delivery channel 420 in the slide 310. This is placed so that it is only in register with an oil delivery channel 810 in the casing 700 when the slide 310 is in its loaded position, shown in FIG. 8.

Figure 10:
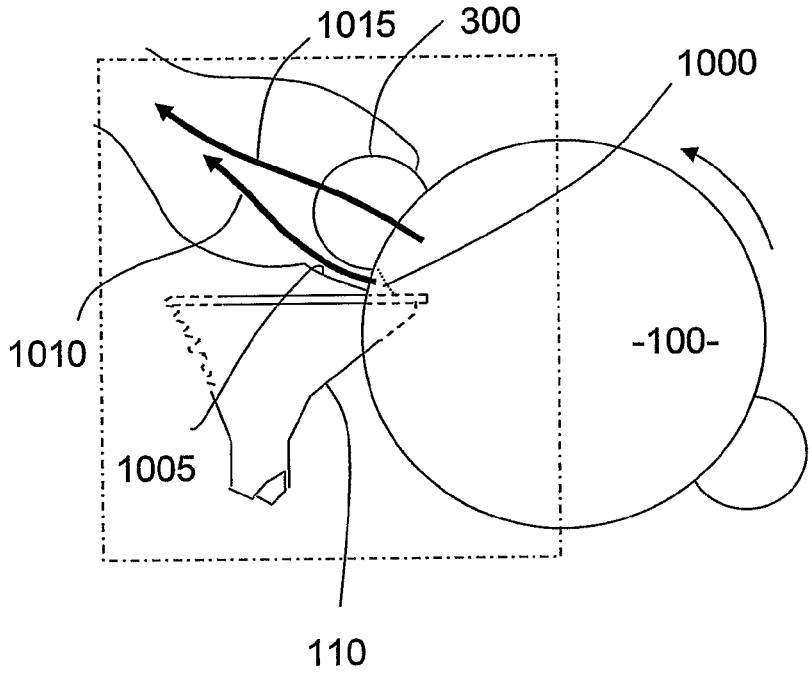
FIG. 10 shows diagrammatically, in cross section, a discharge path for gases otherwise trapped in use of a compressor as shown in FIG. 3.

Referring to FIG. 10, in prior art compressors, a recognised problem has been that gas can be trapped in the last portion 1000 of the flutes 105. To deal with this, it is known to provide a channel 1005 in the compressor casing which opens to that last portion 1000 of the flutes 105, giving an escape pathway 1010 for gas past the slide 300 to the discharge port. However, to avoid leakage of gas back through the escape pathway 1010, it has been necessary to incorporate a non-return or check valve in the discharge port.

Figure 11:
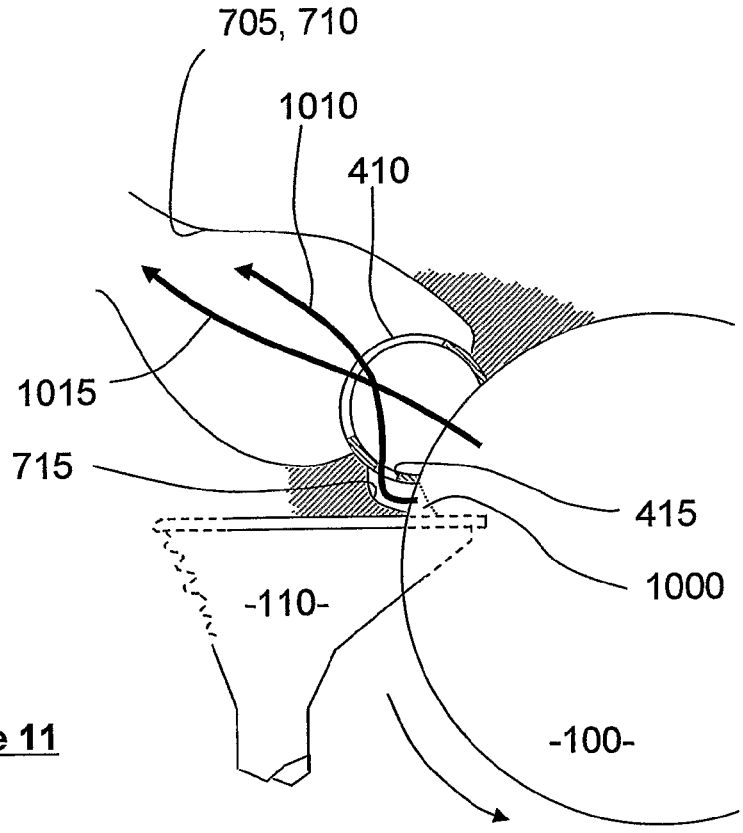
FIG. 11 shows diagrammatically, in cross section, a discharge path for gases otherwise trapped in use of a compressor according to the present invention.

FIG. 11 shows an area equivalent to the dot/dash box shown in FIG. 10. In embodiments of the present invention as shown in FIG. 11, the additional outlet port 715 of the compressor casing 700 provides that escape pathway 1010 but into the slide 310 via the slots 415. This means the residual gas can reach the discharge port 705 and/or the bypass port 710 at all times. When the discharge port 705 is closed, the gas can escape via the bypass port 710, which obviates the need for any check valve.

(In general in embodiments of the present invention, it will be understood that the exit port 410 of the slide 310 should be large enough, and the bypass port 710 in the casing 700 should be large enough, to prevent the build up of pressure within the rotor 100 sufficient to affect the compressor efficiency when in the unloaded state.)

Referring to FIGS. 12 to 15, the operation of the slots 415 and the extended recess 425 connected to the exit port 410 of the slide 310 to vent the flutes 105 as the slide moves is as follows.

FIGS. 12 to 15 show the upper slide 310 in a series of positions, from unloaded through to loaded.

In FIG. 12, three slots 415 are visible in the recess 425 of the slide 310. The recess 425 itself is in communication, via the exit port 410, with the bypass port 710 of the casing 700. Numbering the slots 415 from the left as shown in the figure, "Slot 1" is in communication with the additional outlet port 715 of the casing 700.

In FIG. 13, the slide 310 has moved a step towards the loaded position. The exit port 410 is still partially in communication with the bypass port 710 of the casing 700. "Slots 1 and 2" are now in communication with the additional outlet port 715 of the casing 700.

In FIG. 14, the slide 310 has moved a step further towards the loaded position. The exit port 410 is partially in communication with the discharge port 705 and the bypass port 710 (not seen in FIG. 14) of the casing 700. "Slots 2 and 3" are now in communication with the additional outlet port 715 of the casing 700.

In FIG. 15, the slide 310 is in the loaded position. The exit port 410 is only in communication with the discharge port 705 of the casing 700. Only "Slot 3" is in communication with the additional outlet port 715 of the casing 700.

It will be noted that, in order to provide continuous venting of the flutes 105 throughout all positions of the slide 310, the distance between consecutive pairs of slots 415 should be less than the dimension, of the additional outlet port 715 in the casing 700 in said axial direction, at the junction between the openings and the additional outlet port 715. The additional outlet port 715 needs to be able to bridge the gap between adjacent slots 415 so that it opens to a neighbouring slot 415 before being closed to the previous one.

It is not essential to use a series of three slots 415 as an additional inlet port to the slide 310. It would be possible to use one extended aperture, or two extended apertures or a shape other than slots. However, the use of a series of openings such as slots maintains strength in the slide 310.

Figure 16:
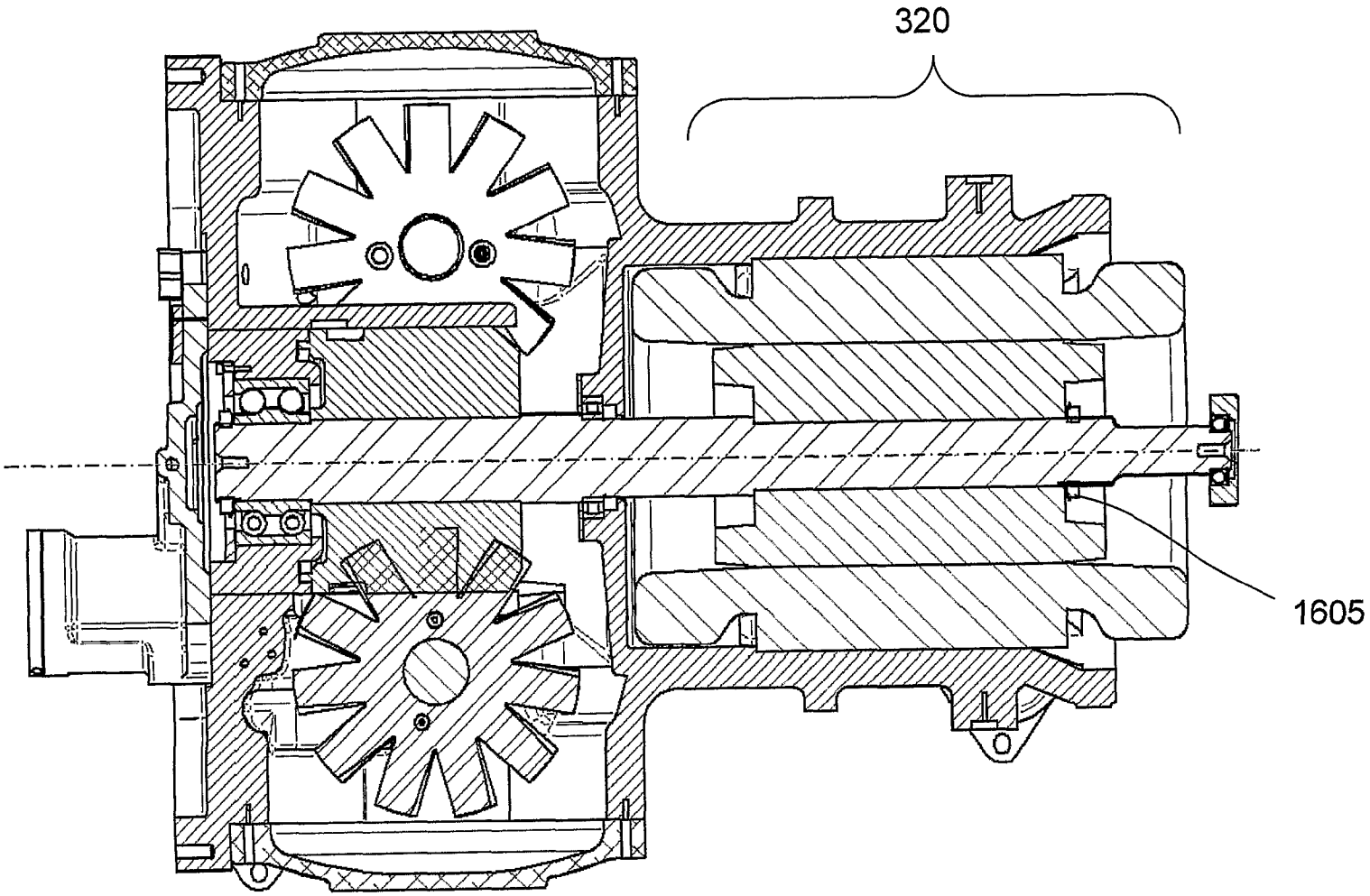
FIG. 16 shows in horizontal cross section a bearing arrangement for use in the compressor of FIG. 4.

Referring to FIG. 16, one of the advantages of a single screw compressor when compared to other types of screw compressor is the absence of radial loads on the main rotor. Those familiar with single screw compressor will realise that this advantage has been sacrificed to a limited extent in embodiments of the invention to allow for more efficient part load operation.

There already exist single screw compressors that operate with only one gate rotor. Single gate compressors deal with radial loads by an additional main bearing. In asymmetric single screw compressors according to embodiments of the invention the radial load difference between the two sides increases as the compressor unloads and reaches a maximum at 50% load. However at the same time the total compressor load is falling as the compressor unloads and the input power falls. Bearing arrangements are possible that adequately match all loading requirements.

FIG. 16 shows a suitable bearing arrangement. The number of main bearings is increased with the overhung motor 320 receiving a third outboard bearing 1605, thereby ensuring a robust and vibration free compressor. The bearing 1605 is primarily to accommodate the large size of the compressor. It is no longer viable to allow the motor 320 to overhang the bearing supports and thus a third bearing position is introduced. The two angular contact bearings on the other end are larger than would be necessary in a symmetric compressor due to the asymmetric loads. However, unlike a single star compressor which runs all its life with high radial loads and needs an extra cylindrical roller bearing adjacent to the angular contact bearings to provide adequate bearing life, the asymmetric unloading in embodiments of the invention will only see this same loading at the 50% load point. At higher loads there will be a varying asymmetric radial load and at lower loads the asymmetric load will fall due to the lower pressures expected at the low load conditions.

Figure 17:
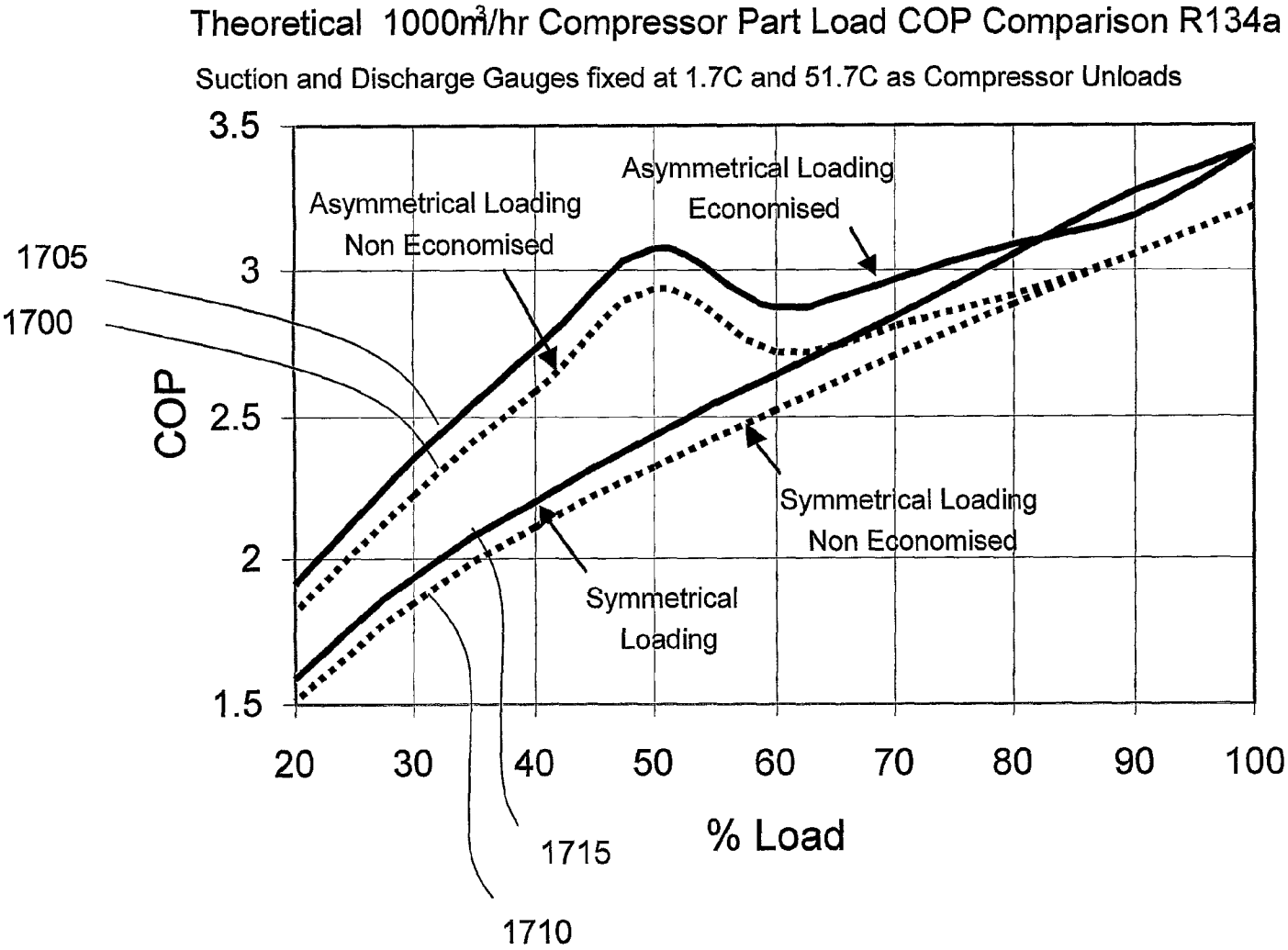
FIG. 17 shows a graphical comparison of COP for compressors subject to asymmetrical and symmetrical loading and with and without economisers.

FIG. 17 shows a theoretical comparison of the coefficient of performance ("COP") in single screw compressors operating with standard and asymmetric unloading. It can be seen that asymmetric unloading 1700, 1705, as envisaged by embodiments of the invention, can be expected to offer significantly greater COP than standard loading 1710, 1715, particularly in the 40% to 60% loading range. Indeed, it is believed the part load operation efficiency approaches that of a variable speed driven compressor.

In a single screw compressor of asymmetric design there is yet another advantage, two economiser connections to the two separate compression processes. These ports can be used not just to improve efficiency and capacity as in a conventional screw compressor, but can also be used in the asymmetric design to make the advantage of economiser operation available down to a lower part load condition. Typically with conventional slides little gain is available below 70% load, asymmetric operation makes these gains available down to 35% load.

Economiser use can reduce or eliminate the step between the 50 to 62% load positions introduced by the asymmetric arrangement. If the modulating slide is operating at part load with a rising load requirement, the economiser port of this slide can be opened to the economiser system when this slide is at a high load condition thus continued loading of the slide will bring the capacity to 62% of the non economised capacity (rather than the 50% obtained with the economiser off). The next loading step is to change to step slide at full load, modulating slide at minimum load, with both economiser ports closed. This also corresponds to 62% of the non economised capacity matching the previous load state. Economising of this slide can be re-introduced to maintain maximum efficiency as the load continues to increase.

Results regarding use of an economiser are also shown in FIG. 17 by the curves 1700, 1705. Two stage economising could be easily incorporated into the design and this should result in a further increase in efficiency.

The function of the step slide could be further enhanced to provide a variable volume ratio to this side of the compression process thereby improving compressor efficiency at 50% load and above The design of the variable slide and the associated ports could be developed to match the changing operating condition of a chiller using the compressor such that the VR varies as required for the specific chiller application.

It will be understood that various modifications could be made to arrangements such as those described above without departing from the scope of the invention. At a simple level for example, the positions of the slides 305, 310 could be exchanged so that the lower slide is a slide according to an embodiment of the invention instead of the top or upper slide.

The invention claimed is:

1. A slide configured for use in a single screw compressor, the compressor comprising a main rotor and at least one gate rotor, a casing for the main rotor having a discharge port and a bypass port spaced in an axial direction in relation to the main rotor, the slide comprising a first sealing surface configured to seal the bypass port and a second sealing surface configured to seal the discharge port and wherein an exit port is positioned between the first sealing surface and second sealing surface, the slide further comprising at least one inlet port for receiving gas from flutes of the main rotor for delivery to the exit port, the slide being configured to be operable, in use, to move between:

i) a loaded position in which the exit port opens to the discharge port in the casing and the first sealing surface seals the bypass port, and ii) an unloaded position in which the exit port opens to a bypass port in the casing and the second sealing surface seals the discharge port.

2. The slide according to claim 1 wherein the compressor casing has an additional outlet port, providing an opening to discharge ends of the flutes at a position outside the slide, between the slide and an associated gate rotor, and the slide comprises at least one additional inlet port for receiving gas from the additional outlet port in the casing for delivery to the exit port.

3. The slide according to claim 2 wherein the additional inlet port provided in the slide preferably extends in an axial direction in relation to the main rotor, in use, such that the additional outlet port in the casing always communicates with the additional inlet port.

4. The slide according to claim 3 wherein the additional inlet port is provided as a series of two or more openings spaced in said axial direction, the distance between consecutive pairs of the openings being less than the dimension of the additional outlet port in the casing in said axial direction, at the junction between the openings and the additional outlet port.

5. The slide according to claim 2 wherein the additional inlet port extends further in the axial direction of the slide than the exit port.

6. A single screw compressor for use with a slide according claim 2, the compressor comprising a casing having a discharge port and a bypass port spaced in an axial direction in relation to the main rotor, and an additional outlet port, providing an opening to receive gas from the discharge ends of the flutes at a position outside the slide, in use, and delivering it to the additional inlet port of the slide.

7. The single screw compressor according to claim 6 wherein the discharge port and the bypass port are at least partially aligned with one another in the axial direction in relation to the main rotor.

8. The single screw compressor according to claim 6 wherein the discharge port is arranged to face a surface axially offset from the main rotor.

9. The single screw compressor according to claim 8 wherein said surface is provided by a bearing housing of the compressor.

10. The single screw compressor according to claim 6 wherein the additional outlet port is provided by a shaped channel in the compressor casing.

11. The single screw compressor according to claim 6, for use with said slide, the slide having an oil pathway for injection of oil to the compressor in use, which pathway opens in register with an oil delivery channel when the compression process is in the fully loaded state, being otherwise out of register, the compressor being provided with the oil delivery channel which is in register with the oil pathway in the slide only when the compression process is in the fully loaded state.

12. The slide according to claim 1, comprising a rod-like body, having a face shaped to fit against an outer surface of the main rotor, in use of the compressor, said face having the inlet port therein.

13. The slide according to claim 12 where the slide's inlet port connects to a recess in the face of the slide which provides a path to the exit port.

14. The slide according to claim 13 wherein an additional inlet port is provided into the recess, between the inlet port in the face and the exit port.

15. The slide according to claim 1, the slide having an oil pathway for injection of oil to the compressor in use, which pathway opens in register with an oil delivery channel when the compression process is in the fully loaded state, being otherwise out of register.

16. The single screw compressor for use with a slide according claim 1, the compressor comprising a casing having a discharge port and a bypass port spaced in an axial direction in relation to the main rotor, wherein the discharge port is arranged to face a surface axially offset from the main rotor.

17. The single screw compressor according to claim 16 wherein said surface is provided by a bearing housing of the compressor.

* * * * *